US010451270B2

(12) United States Patent
Winter et al.

(10) Patent No.: US 10,451,270 B2
(45) Date of Patent: Oct. 22, 2019

(54) METHOD AND DEVICE FOR GENERATING SUPERHEATED STEAM FROM A WORKING MEDIUM

(71) Applicant: NETZSCH Trockenmahltechnik GmbH, Selb (DE)

(72) Inventors: Frank Winter, Mühlheim (DE); Thorsten Uhl, Neuberg (DE)

(73) Assignee: NETZSCH Trockenmahltechnik GmbH, Selb (DE)

( * ) Notice: Subject to any disclaimer, the term of this patent is extended or adjusted under 35 U.S.C. 154(b) by 86 days.

(21) Appl. No.: 15/434,714

(22) Filed: Feb. 16, 2017

(65) Prior Publication Data

US 2017/0234528 A1 Aug. 17, 2017

(30) Foreign Application Priority Data

Feb. 17, 2016 (DE) ..... 10 2016 102 777

(51) Int. Cl.

| | |
|---|---|
| ***F22D 1/12*** | (2006.01) |
| ***F22G 1/02*** | (2006.01) |
| ***F22G 3/00*** | (2006.01) |
| ***F22G 5/00*** | (2006.01) |

(52) U.S. Cl.

CPC ..... *F22D 1/12* (2013.01); *F22G 1/02* (2013.01); *F22G 3/002* (2013.01); *F22G 5/00* (2013.01)

(58) Field of Classification Search

CPC ..... F22D 1/12; F22G 1/02

See application file for complete search history.

(56) References Cited

U.S. PATENT DOCUMENTS

| | | | | |
|---|---|---|---|---|
| 3,134,367 | A * | 5/1964 | Halle | F22B 35/104 122/448.4 |
| 3,164,135 | A * | 1/1965 | Von Beck | F22G 5/00 122/451 S |
| 3,269,368 | A * | 8/1966 | McCoy | F22G 1/16 122/479.1 |
| 3,488,961 | A * | 1/1970 | Hansruedi | F01K 7/24 237/12.1 |
| 3,525,673 | A * | 8/1970 | Cameron | C10B 49/02 110/346 |

(Continued)

FOREIGN PATENT DOCUMENTS

| | | |
|---|---|---|
| DE | 3216298 A1 | 12/1982 |
| DE | 4216278 A1 | 11/1993 |

(Continued)

OTHER PUBLICATIONS

JP09236207A—machine translation.*

*Primary Examiner* — Nathaniel Herzfeld

(74) *Attorney, Agent, or Firm* — Whitmyer IP Group LLC

(57) ABSTRACT

A method and a device for generating superheated steam from a working medium, which includes the following steps: feeding of a working medium in the liquid phase to a specific heating tube and temperature regulation of the specific heating tube. Furthermore, the specific heating tube is temperature-regulated with a defined amount of thermal energy, as a result of which superheated steam is formed in the specific heating tube from the working medium fed in the liquid phase, the superheated steam then departing from the specific heating tube.

19 Claims, 2 Drawing Sheets

(56) References Cited

U.S. PATENT DOCUMENTS

| | | | | | |
|---|---|---|---|---|---|
| 3,774,396 | A * | 11/1973 | Borsi | F22B 35/10 | 60/645 |
| 3,818,699 | A * | 6/1974 | Pritchard | F22G 5/12 | 60/665 |
| 3,942,483 | A * | 3/1976 | Laubli | F22B 35/10 | 122/448.1 |
| 4,418,539 | A * | 12/1983 | Wakamatsu | F01D 19/02 | 60/646 |
| 5,237,816 | A * | 8/1993 | Duffy | F01K 23/108 | 60/39.182 |
| 5,307,766 | A * | 5/1994 | Pearce | F22G 5/12 | 122/406.4 |
| 5,494,520 | A * | 2/1996 | Lamendola | B05C 1/08 | 118/232 |
| 5,626,104 | A * | 5/1997 | Tanaka | F22B 31/00 | 122/367.1 |
| 7,383,791 | B2 * | 6/2008 | Franke | F22B 1/1815 | 122/1 B |
| 9,516,986 | B1 * | 12/2016 | Williams | A47L 11/4086 | |
| 2007/0227145 | A1 * | 10/2007 | Conturie | F22B 1/003 | 60/653 |
| 2014/0123914 | A1 * | 5/2014 | Stark | F22B 37/26 | 122/1 B |

FOREIGN PATENT DOCUMENTS

| | | | | |
|---|---|---|---|---|
| DE | 102014115726 | A1 | | 4/2015 |
| JP | 09236207 | A | * | 9/1997 |
| WO | 2008009686 | A2 | | 1/2008 |

* cited by examiner

METHOD AND DEVICE FOR GENERATING SUPERHEATED STEAM FROM A WORKING MEDIUM

TECHNICAL FIELD

The present invention relates to a method and a device for generating superheated steam from a working medium.

BACKGROUND

Devices are already known from the prior art by means of which superheated steam can be generated from working media. For example, a water tube boiler can be provided for producing superheated steam, said water tube boiler heating water by means of a burner up to the boiling point and thereby generating saturated steam. The saturated steam can be present in a steam drum and can be conveyed onward from the latter to a superheater, in which the saturated steam is subjected to thermal energy to expel moisture from the saturated steam and thus to form superheated steam.

High-speed steam generators are also known, which comprise a steam coil which is subjected to temperature by means of a burner in order to form wet steam from water. In order to generate superheated steam from the wet steam, embodiments are known wherein a superheater is arranged downstream of the respective high-speed steam generator.

Devices for generating superheated steam known from the prior art are thus constituted in a two-stage form, for which reason a high structural outlay is required to produce superheated steam from water in the liquid phase.

For this reason, a problem of the invention can be regarded as making available a method and a device, by means of which superheated steam can be produced from a working medium in a straightforward and uncomplicated manner. The device should also be able to be produced at a favourable cost. Furthermore, the method should be able to be implemented at a favourable cost.

The above problems are solved by a method and a device which comprise the features in protective claims 1 and 9. Further advantageous embodiments are described by the sub-claims.

SUMMARY

The invention relates to a method for generating superheated steam from a working medium. The working medium can be constituted by water or feed water. In the context of the method, the working medium is fed in the liquid phase to a specific heating tube. The specific heating tube can be constituted as a coil or steam coil. Furthermore, the heating tube is temperature-regulated.

Provision is made here such that the specific heating tube is temperature-regulated with a defined amount of thermal energy, as a result of which superheated steam is formed in the specific heating tube or in the specific one heating tube from the working medium fed in the liquid phase, said superheated steam then departing from the specific heating tube.

Compared to the methods known from the prior art, the transfer of the working medium from the liquid phase into the gaseous phase up to the generation of the superheated steam can take place within the scope of the method according to the invention in one specific heating tube or in one specific heating coil, whereas at least two separate heating devices are provided in the method known from the prior art in order to transfer working medium from the liquid phase into superheated steam.

In preferred embodiments, provision can also be made such that the working medium is preheated before it is fed to the specific heating tube. For example, the working medium can be preheated by means of an economiser before it is fed to the specific heating tube. The temperature of the working medium after the preheating can be in a range between 60° C. and 200° C. and in particular in a range between 100° C. and 150° C. Furthermore, the preheated working medium can be fed pressurised to the specific heating tube, so that the working medium continues to be in the liquid phase at a temperature between 60° C. and 200° C. or between 100° C. and 150° C.

It is also conceivable for the working medium to be brought to an essentially constant temperature level in the course of the preheating and to be passed on to the specific heating tube at the essentially constant temperature level. The constant temperature level can lie in a range which, as already mentioned above, is fixed between 100° C. and 150° C. and in particular between 120° C. and 130° C.

It is conceivable, for example, for the working medium to be located or stored in a reservoir and to be heated in the reservoir to a temperature above or below 100° C. After heating, the working medium can leave the reservoir and be fed to an economiser, which further raises the temperature of the working medium between 60° C. and 200° C. and in particular between 100° C. and 150° C.

Once working medium leaves the reservoir, further working medium can be fed to the reservoir, so that a volume of working medium accommodated by the reservoir and the temperature of the working medium accommodated in the reservoir are kept at least approximately constant or are not subjected to any major fluctuations.

Embodiments have also proved expedient wherein the defined amount of thermal energy is made available by the exhaust gas volume flow of a burner operated with a liquid, gaseous or solid fuel. The preheating of the working medium can also take place with the aid of the exhaust gas volume flow. In particular, the exhaust gas volume flow can first pass through the specific heating tube and then be conveyed onward to a heat exchanger or economiser, in order to bring about a temperature regulation or preheating of the working medium. The specific heating tube can be arranged in a work housing, into which the specific amount of thermal energy is introduced by the exhaust gas volume flow of the burner operated with liquid, gaseous or solid fuel for the purpose of the temperature regulation of the specific heating tube. Furthermore, a chimney or outlet can be arranged downstream of the economiser, via which chimney or outlet the exhaust gas volume flow is discharged after preheating of the working medium and after provision of the defined amount of thermal energy for the specific heating tube.

In addition, provision can be made such that an actual temperature level of the superheated steam is detected and/or ascertained and that the defined amount of thermal energy is constituted by taking account of the detected and/or ascertained actual temperature level. If the detected actual temperature level is low with respect to the setpoint temperature level, the defined amount of thermal energy can be increased. If the detected actual temperature level is raised with respect to the setpoint temperature level, the defined amount of thermal energy can be reduced.

The method can thus be implemented with the aid of a control or a controlled circuit, wherein the amount of thermal energy with which the specific heating tube is temperature-regulated is adapted taking account of an actual temperature level of the superheated steam. The adaptation of the given amount of thermal energy to the given detected actual temperature level of the superheated steam can take place at least approximately in real time. Advantageously, a temperature level of the superheated steam can be kept at least approximately constant without significant fluctuations. For the detection of the actual temperature level, at least one sensor can be provided, which is positioned in a flow path of the superheated steam. The at least one sensor can be connected to a control unit described below or can optionally be coupled to a control unit described below.

Furthermore, it may be the case that the specific heating tube is temperature-regulated with a first defined amount of thermal energy, as a result whereof working medium changes from the liquid phase into the gaseous phase in the specific heating tube. Furthermore, the specific heating tube can, subsequent thereto, be temperature-regulated with a second defined amount of thermal energy with a higher energy level, as a result of which the superheated steam is formed from the working medium changed into the gaseous phase. For this purpose, the burner can be suitably controlled in order to subject the specific heating tube to different amounts of thermal energy in successive steps. In particular, provision can be made for this during commissioning of the device or at the start of the implementation of the method. If working medium or water that is not preheated or only insufficiently preheated is introduced into the specific heating tube and the specific heating tube is subjected directly thereafter to a defined amount of thermal energy, by means of which amount superheated steam is formed from the working medium or water, high loading of the specific heating tube is associated therewith, which may possibly lead to damage to the specific heating tube. Previously described embodiments have thus proved expedient wherein the specific heating tube is subjected to different amounts of thermal energy in successive steps at least during the commissioning of the device. In particular, it may be the case that the specific heating tube is temperature-regulated with a first defined amount of thermal energy, while working medium or water is introduced into the specific heating tube that has a first temperature level. Subsequent to this, the specific heating tube can be temperature-regulated with a second defined amount of thermal energy, while working medium or water is introduced into the specific heating tube that has a second temperature level. The second temperature level can be raised in respect of the first temperature level.

It may be the case that solids are size-reduced by means of the superheated steam after leaving the specific heating tube. In this regard, the superheated steam can be passed on to a jet mill, which size-reduces solids by means of superheated steam.

The invention also relates to a device for generating superheated steam from a working medium. Features which have previously been described in respect of conceivable embodiments of the method according to the invention can also be provided with the device according to the invention. Furthermore, features described below in respect of conceivable embodiments of the device according to the invention can be provided with previously described methods, so that these features are not repeatedly mentioned.

The device comprises a specific heating tube to which working medium in the liquid phase can be fed. Furthermore, the device comprises a temperature-regulating device for subjecting the specific heating tube to thermal energy as well as a control unit which is connected to the temperature-regulating device or which can control the temperature-regulating device.

Furthermore, provision is made such that the control unit has information by means of which the control unit can control the temperature-regulating device for the purpose of delivering a defined amount of thermal energy to the specific heating tube, which defined amount of thermal energy is constituted for producing superheated steam in the specific heating tube or in the one specific heating tube from the working medium fed in the liquid phase.

In preferred embodiments, provision can also be made such that the specific heating tube is constituted as a coil or heating coil.

Furthermore, embodiments have proved expedient wherein the specific heating tube is formed by steel with at least one of the alloy elements chromium, molybdenum, silicon and/or copper. In particular, the specific heating tube can be constituted by 13CrMo45.

It is also conceivable for the device to comprise at least one device for preheating the working medium in the liquid phase, which at least one device is coupled fluidically to the specific heating tube. The at least one device can be constituted as an economiser and can be operatively connected to the temperature-regulating device for the preheating of the working medium in the liquid phase. The temperature-regulating device can be constituted as a burner for liquid or gaseous fuels and can optionally provide the defined amount of thermal energy for the specific heating tube via an exhaust gas volume flow.

In conceivable embodiments, it may be the case that the control unit can control the temperature-regulating device for the delivery of a first defined amount of thermal energy to the specific heating tube, which first defined amount of thermal energy is constituted for producing saturated steam from the working medium fed in the liquid phase to the specific heating tube and which control unit can control the temperature-regulating device for the delivery of a second defined amount of thermal energy to the specific heating tube subsequent to the delivery of the first defined thermal energy, wherein an energy level of the second defined amount of thermal energy is increased compared to an energy level of the first defined amount of thermal energy and which second defined amount of thermal energy is constituted for producing superheated steam from the saturated steam.

Furthermore, it may be the case that the device comprises at least one sensor for ascertaining an actual temperature level of the superheated steam, said sensor being connected to the control unit, wherein the control unit is constituted for controlling the defined amount of thermal energy taking account of the given detected actual temperature level.

In addition or alternatively, at least one further sensor can also be provided, which is arranged in a flow path or in the region of a flow path of the working medium or water not yet fed to the specific heating tube. The control unit can be constituted by means of at least one further sensor to ascertain an actual temperature level of the working medium in the liquid phase, wherein the control unit is constituted for controlling the defined amount of thermal energy taking account of the given detected actual temperature level of the working medium in the liquid phase.

In practice, embodiments are also conceivable wherein the device comprises a size-reduction device for solids or a jet mill, which is in fluidic communication with the specific heating tube, so that superheated steam can be fed to the size-reduction device or the jet mill.

BRIEF DESCRIPTION OF THE DRAWINGS

Examples of embodiment of the invention and its advantages are to be explained in greater detail below with the aid of the appended figures. The size ratios of the individual elements with respect to one another in the figures do not always correspond to the actual size ratios, since some forms are represented simplified and other forms are represented enlarged in relation to the other elements for the sake of better illustration

DETAILED DESCRIPTION

Identical reference numbers are used for identical or identically acting elements of the invention. Furthermore, for the sake of a clearer view, only reference numbers are represented in the individual figures that are required for the description of the respective figure. The represented embodiments only represent examples as to how the invention can be constituted and do not represent a conclusive limitation.

Figure 1:
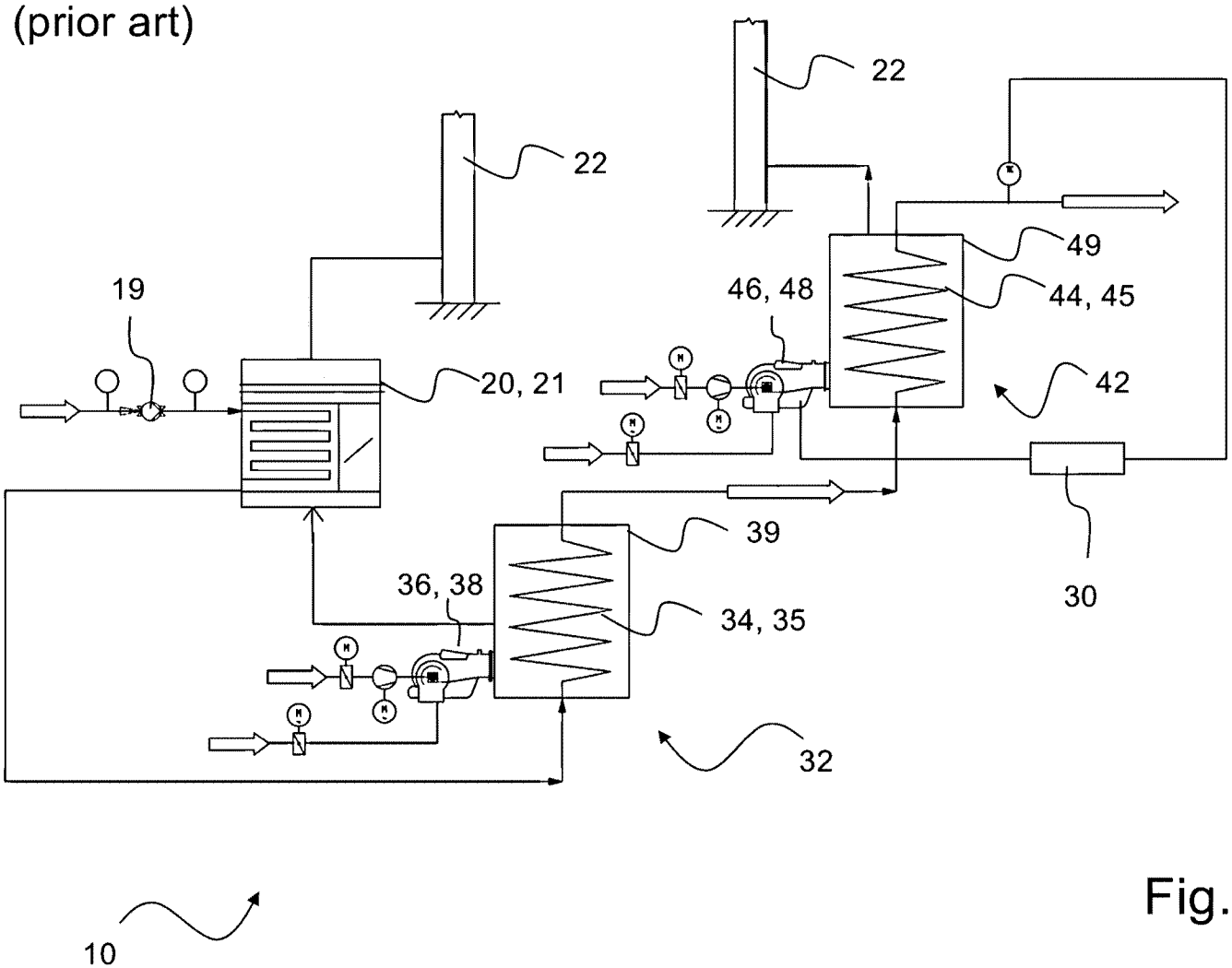
FIG. 1 shows a diagrammatic view of a device for generating superheated steam already known from the prior art.

FIG. 1 shows a diagrammatic view of a device 10 for generating superheated steam already known from the prior art. Device 10 already known from the prior art comprises a feed water pump 19, by means of which water is moved in the direction of a heat exchanger 20, constituted as an economiser 21. The water is preheated by heat exchanger 20 and thereafter fed to an evaporator 32. As can be seen in FIG. 1, evaporator 32 comprises a heating tube 34, which is constituted as a heating coil 35. In addition, evaporator 32 comprises a housing 39 inside which heating tube 34 or heating coil 35 is positioned.

Thermal energy is introduced into housing 39 of evaporator 32 by means of a temperature-regulating device 36, constituted as a burner 38, in order to subject water present in heating tube 34 or heating coil 35 to temperature. Saturated steam is thus formed from the water, said saturated steam leaving housing 39 and moving onward in the direction of a superheater 42.

The exhaust gas volume flow of temperature-regulating device 36 or of burner 38, after passing through heating tube 34 or heating coil 35, is conveyed onward to heat exchanger 20 or economiser 21, which, as already described above, brings about preheating of the water. The exhaust gas volume flow then leaves device 1 via a chimney 22.

A further temperature-regulating device 46, which is also constituted as a burner 48, is assigned to superheater 42. The superheater 42 also comprises a housing 49 in which a heating tube 44 is positioned. Heating tube 44 is constituted as a heating coil 45. By means of burner 48, an exhaust gas volume flow is introduced into housing 49 of superheater 42, which further heats the saturated steam present in heating tube 44 or heating coil 45, in order to form superheated steam from the saturated steam in heating tube 44 or in heating coil 45. The amount of thermal energy passed on by burner 48 to heating tube 44 of superheater 42 is greater than an amount of thermal energy passed on by burner 38 to heating tube 34 of evaporator 32. The superheated steam then leaves superheater 42 or heating tube 44 assigned to superheater 42 and can then be used to perform various functions. The exhaust gas volume flow, which has been introduced by means of burner 48 into housing 49 of superheater 42, leaves superheater 42 via a further chimney 22.

A control unit 30 can also be seen. Control unit 30 is coupled with burner 48 which introduces thermal energy into housing 49 of superheater 42. Furthermore, control unit 30 is connected to burner 38 which introduces thermal energy into housing 39 of evaporator 32 (not represented). Control unit 30 can control the given amount of thermal energy to be delivered via burners 38 and 48.

Figure 2:
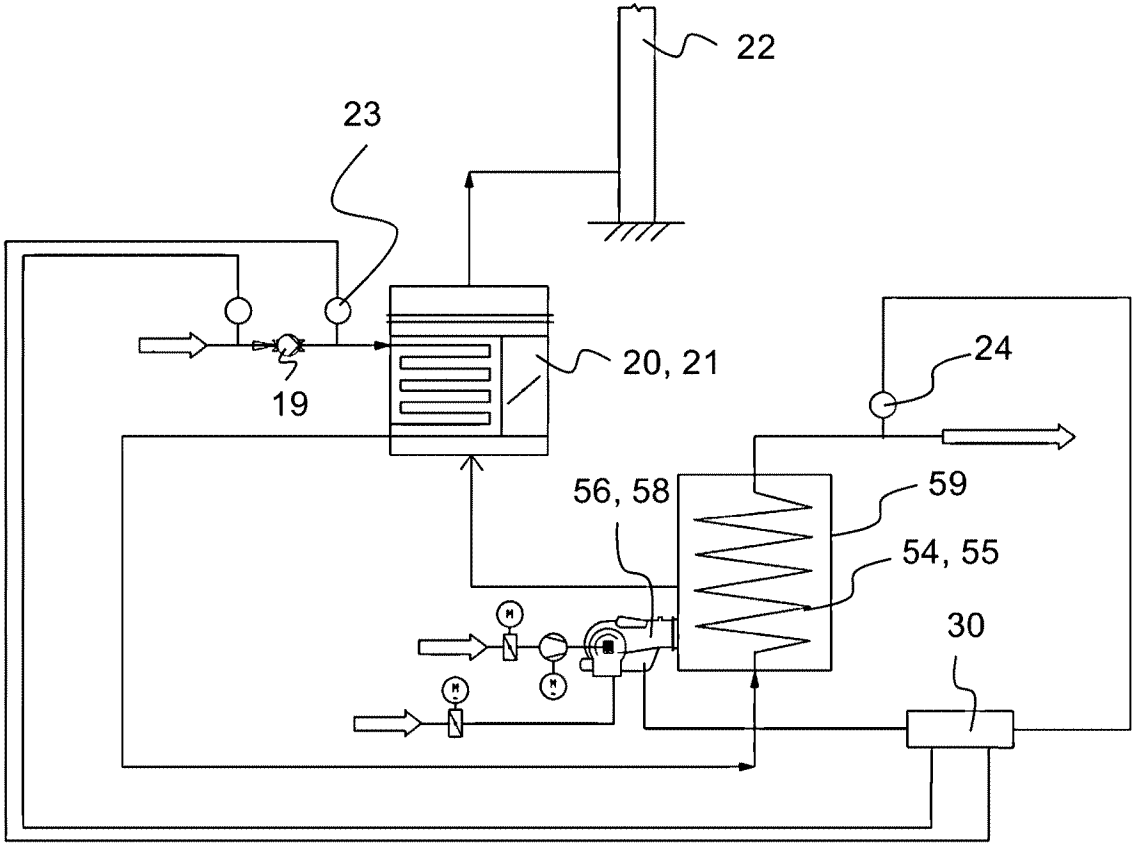
FIG. 2 shows a diagrammatic view of an embodiment of the device according to the invention and also illustrates individual steps as to how it can be provided with conceivable embodiments of the method according to the invention

FIG. 2 shows a diagrammatic view of an embodiment of device 1 according to the invention and also illustrates individual steps such as can be provided with conceivable embodiments of the method according to the invention.

Device 1 is provided for generating superheated steam from a working medium or water. For this purpose, device 1 comprises a heat exchanger 20, by means of which the working medium or water is subjected to a temperature and preheated. Heat exchanger 20 is constituted as an economiser 21 and is in fluidic communication with a reservoir for feed water not represented in FIG. 2. A feed water pump 19 is provided in order to remove working medium or water from the reservoir and to feed it to heat exchanger 20 or economiser 21.

In order to keep a temperature level at which feed water enters into economiser 21 as constant as possible, a volume of water as constant as possible with a temperature as constant as possible is present in the reservoir (not represented). For example, the water or feed water can be fed to economiser 21 at a temperature which lies between 80° C. and 100° C. By means of economiser 21, the temperature level of the water or feed water can be further increased. In particular, it is conceivable for the water or feed water in the reservoir to be temperature-regulated by means of steam or tapped steam. The reservoir can comprise at least one sensor or at least one level sensor, by means of which a given actual volume of water or feed water accommodated in the reservoir can be ascertained. A supply of water or feed water into the reservoir and a temperature regulation of the water or feed water by means of steam or tapped steam can then take place depending on the given ascertained actual volume.

Once the water or feed water has been preheated by means of economiser 21, the water or feed water in the liquid phase is conveyed onward to a specific heating tube 54 and is introduced in the liquid phase into specific heating tube 54. Specific heating tube 54 is constituted as a heating coil 55 and is located inside a work housing 59 or is accommodated by a work housing 59.

A temperature-regulating device 56 can also be seen in FIG. 2, which is constituted as a burner 58 operated with liquid fuel and/or gaseous fuel. Burner 58 introduces an exhaust gas volume flow into housing 59 in order to temperature-regulate specific heating tube 54 or the heating coil with a specific amount of thermal energy. The working medium or water thus changes from the liquid phase into the gaseous phase, wherein superheated steam is formed from the working medium or water. The superheated steam then leaves work housing 59 or specific heating tube 54 and is conveyed onward to a jet mill not represented in FIG. 2, which size-reduces solids by means of the superheated steam.

The capacity of temperature-regulating device 56 or of burner 58 is controlled by control unit 30. For this purpose, control unit 30 has information by means of which control unit 30 can control temperature-regulating device 56 or burner 58 for the delivery of a defined amount of thermal energy, in order to produce superheated steam from the working medium or water fed in the liquid phase to specific heating tube 54.

A control of temperature-regulating device 56 or of burner 58 also takes place taking account of an actual temperature level of the superheated steam. For this purpose, a temperature sensor 24 is provided, which is positioned in a flow path or in the region of a flow path of the superheated steam. Temperature sensor 24 is connected to control unit 30. By means of temperature sensor 24, control unit 30 is thus able to ascertain the given actual temperature of the superheated steam and, taking account of the given actual temperature, to control burner 58 for the delivery of a defined amount of thermal energy, in order to form the superheated steam with an essentially constant temperature level.

A further temperature sensor 23 can also be seen, which is also connected to control unit 30. By means of further temperature sensor 23, control unit 30 can ascertain the temperature level of the water or working medium, before the latter is fed to heat exchanger 20 or economiser 21. Since an amount of thermal energy essentially constant in the course of time is fed to the working medium or water via economiser 21, the temperature of the working medium or the water at which the working medium or water enters into specific heating tube 54 is fed dependent on the temperature at which the working medium or the water is fed to economiser 21. A control of the capacity of burner 58 or of the amount of thermal energy to which specific heating tube 54 is subjected by burner 58 can thus take place by means of control unit 30 taking account of the actual temperature level of the working medium or water ascertained by sensor 23. If an actual temperature level ascertained by sensor 23 falls, the capacity of burner 58 can be increased via control unit 30. If an actual temperature level ascertained by sensor 23 increases, a capacity of burner 58 can be reduced via control unit 30. The control can take place at least approximately in real time or can take account of a path which the working medium or water has covered from sensor 23 up to its entry into specific heating tube 54.

FIG. 2 also shows a chimney 22, via which the exhaust gas volume flow generated by burner 58 can escape from device 1. The exhaust gas volume flow is first introduced into work housing 59 in order to subject specific heating tube 54 to a defined amount of thermal energy. Subsequently, the exhaust gas volume flow is conveyed onward to heat exchanger 20 or economiser 21 for the preheating of the working medium or water. After delivery of thermal energy to heat exchanger 20 or economiser 21, the exhaust gas volume flow leaves device 1 via chimney 22.

As indicated in FIG. 2 by means of an arrow display, the superheated steam leaves work housing 59 or specific heating tube 54 and can then be moved onward and be used for various work processes. In practice, embodiments have proved expedient wherein the superheated steam is fed to a jet mill, which size-reduces solids by means of the superheated steam. It is clear to the addressed person skilled in the art that the superheated steam produced via device 1 can also be used for further work processes that do not involve the size-reduction of solids.

Combined viewing of device 10 from FIG. 1 already known from the prior art and of the embodiment of device 1 from FIG. 2 according to the invention reveals that two burners 38 and 48 are provided for evaporator 32 and superheater 42 in the case of device 10 from FIG. 1, whereas device 1 from FIG. 2 requires only one temperature-regulating device 56 or one burner 58 to generate superheated steam from water in the liquid phase. Two chimneys 22 are thus also required in the case of device 10 according to FIG. 1 in order that the respective exhaust gas volume flow of burners 38 and 48 can be discharged. In contrast, device 1 from FIG. 2 comprises only one chimney 22, which is assigned to the exhaust gas volume flow of burner 58. Device 10 from FIG. 1 also requires two heating tubes 34 and 44 or heating coils 35 and 45 temperature-regulated independently of one another, wherein for device 1 from FIG. 2 only one heating tube 54 or one heating coil 55 is provided inside which superheated steam is formed from working medium in the liquid phase.

Compared with device 10 from FIG. 1 known from the prior art, device 1 from FIG. 2 can thus be set up with a smaller space requirement and reduced assembly time. Since fewer structural elements are required for device 1 from FIG. 2, device 1 can be procured at a more favourable cost and has a reduced likelihood of malfunctions.

The invention has been described by reference to a preferred embodiment. A person skilled in the art can however imagine that modifications or changes to the invention can be made without thereby departing from the scope of protection of the following claims.

What is claimed is:

1. A method for generating superheated steam from a working medium, the method comprising the following steps:

continuously feeding the working medium to a first heat exchanger, the working medium exiting the heat exchanger and flowing towards a specific heating tube inlet:

continuously feeding the working medium in a liquid phase to the specific heating tube inlet and regulating a temperature of the specific heating tube;

discharging the working medium from a specific heating tube outlet;

measuring the temperature of the working medium upstream of the specific heating tube inlet and at the specific heating tube outlet to obtain a liquid temperature and a steam temperature respectively;

wherein in a first state, the liquid phase working medium is provided at a first liquid temperature and the specific heating tube is temperature-regulated with a first amount of thermal energy provided by a burner at a first energy output, as a result of which, the working medium is changed from the liquid phase into a gaseous phase at a first steam temperature in the specific heating tube;

generating an exhaust gas flow with the burner, applying the first amount of thermal energy to the specific heating tube with the exhaust gas flow, and transmitting the exhaust gas flow from the specific heating tube to the heat exchanger:

wherein in a second state, the liquid phase working medium is at a second liquid temperature and the specific heating tube is temperature-regulated with a second amount of thermal energy provided by the burner at a second energy output, the second amount of thermal energy being determined using the second liquid temperature and the first steam temperature, as a result of which superheated steam at the first steam temperature is formed in the specific heating tube from the working medium; and in the second state, said superheated steam then departs from the specific heating tube outlet.

2. The method according to claim 1, wherein the working medium is preheated during a first preheating step before it is fed to the specific heating tube to between 80° C. and 100° C.

3. The method according to claim 2, wherein after the first preheating step, the working medium is brought to a higher temperature level below the boiling temperature of the working medium, during a second preheating step, and passed on to the specific heating tube as a liquid at the higher temperature level.

4. The method according to claim 1, wherein the first and second amounts of thermal energy are made available by exhaust gas flow from the burner, the burner operated with a liquid or gaseous fuel.

5. The method according to claim 2, wherein the preheating of the working medium takes place with the aid of exhaust gas flow from the burner, the burner operated with a liquid or gaseous fuel.

6. The method according to claim 1, wherein solids are size-reduced by means of the superheated steam after leaving the specific heating tube.

7. The method according to claim 3, wherein the second preheating step takes place with the aid of exhaust gas volume flow of a burner operated with a liquid or gaseous fuel.

8. The method according to claim 3, wherein the first and second amounts of thermal energy and a heating energy used during the second preheating step are made available by exhaust gas volume flow of a common burner operated with a liquid or gaseous fuel.

9. A device for generating superheated steam from a working medium, comprising:

a specific heating tube to which the working medium in a liquid phase is continuously fed into a specific heating tube inlet;

a specific heating tube outlet through which the working medium is discharged;

a first heat exchanger to which the working medium is continuously fed, the working medium exiting the heat exchanger and flowing towards the specific heating tube;

a temperature-regulating device for subjecting the specific heating tube to thermal energy;

the first heat exchanger and the specific heating tube connected for transmitting an exhaust gas flow generated by the temperature regulated device from the specific heating tube to the heat exchanger;

a control unit which is connected to the temperature-regulating device;

a first temperature sensor placed upstream from the specific heating tube inlet and measuring a liquid temperature of the working medium;

a second temperature sensor placed at the specific heating tube outlet and measuring a steam temperature of the working medium;

wherein in a first state, the control unit controls the temperature-regulating device for the delivery of a first amount of thermal energy per a unit of time to the specific heating tube;

wherein in the first state, the first amount of thermal energy per the unit of time is provided by the temperature-regulating device for producing steam at a first steam temperature from the working medium fed in the liquid phase at a first liquid temperature to the specific heating tube;

wherein in a second state, the control unit controls the temperature-regulating device for the delivery of a second amount of thermal energy per the unit of time to the specific heating tube subsequent to the delivery of the first amount of thermal energy per the unit of time;

wherein the second amount of thermal energy per the unit of time is provided for producing superheated steam at the first steam temperature from the working medium fed in the liquid phase at a second liquid temperature to the specific heating tube; and wherein the second amount of thermal energy per the unit of time is determined by the control unit based upon the second liquid temperature and the first steam temperature.

10. The device according to claim 9, wherein the specific heating tube is constituted as a coil.

11. The device according to claim 9, wherein the specific heating tube is formed by steel with at least one of the alloy elements chromium, molybdenum, silicon and/or copper.

12. The device according to claim 9, comprising at least one device for preheating the working medium in the liquid phase, said at least one device being coupled fluidically with the specific heating tube.

13. The device according to claim 12, wherein the at least one device is constituted as an economiser and is operatively connected to the temperature-regulating device for the preheating of the working medium in the liquid phase.

14. The device according to claim 9, wherein the temperature-regulating device is constituted as a burner for liquid, gaseous or solid fuels.

15. The device according to claim 9, comprising a work housing inside which the specific heating tube is positioned, wherein the temperature-regulating device is constituted for delivering the first or second amount of thermal energy into the work housing.

16. The device according to claim 9, wherein the second sensor ascertains an actual temperature level of the superheated steam, said second sensor being connected to the control unit, wherein the control unit is constituted for controlling the amount of thermal energy per the unit time taking account of the given detected actual temperature level.

17. The device according to claim 9, comprising a size-reduction device for solids, which is in fluidic communication with the specific heating tube, so that superheated steam can be fed to the size-reduction device.

18. The device according to claim 10, wherein the specific heating tube is formed by steel with at least one of the alloy elements chromium, molybdenum, silicon and/or copper.

19. A method for generating superheated steam from a working medium, the method comprising the following steps:

feeding a first volume of the working medium to a heat exchanger, the working medium exiting the heat exchanger and flowing towards an inlet of a specific heating tube;

feeding the first volume of the working medium at a first liquid temperature in a liquid phase into an inlet of the specific heating tube;

measuring the first liquid temperature of the first volume of the working medium upstream of the inlet;

regulating a temperature of the specific heating tube with a first defined amount of thermal energy, the first defined amount of thermal energy provided by a burner;

the working medium changing from the liquid phase into superheated steam at a first steam temperature in the specific heating tube and being released from the specific heating tube;

measuring the first steam temperature of the working medium as it is released from the specific heating tube;

generating an exhaust gas flow with the burner, applying the first amount of thermal energy to the specific heating tube with the exhaust gas flow, and transmitting the exhaust gas flow from the specific heating tube to the heat exchanger;

feeding a second volume of the working medium to the heat exchanger, the working medium exiting the heat exchanger and flowing towards the inlet of the specific heating tube:

feeding the second volume of the working medium in a liquid phase at a second liquid temperature into the inlet of the specific heating tube;

measuring the second liquid temperature of the second volume of the working medium upstream of the inlet, wherein the second liquid temperature is higher than the first liquid temperature;

regulating the specific heating tube with a second defined amount of thermal energy, the second defined amount of thermal energy provided by the burner and determined using the second liquid temperature and the first steam temperature, wherein the second defined amount of thermal energy is lower than the first defined amount of thermal energy to form superheated steam at the first steam temperature in the specific heating tube from the second volume of working medium; and said superheated steam is then released from the specific heating tube;

measuring the second steam temperature of the superheated steam as it is released from the specific heating tube.

* * * * *